US010864972B2

(12) United States Patent
Vachon et al.

(10) Patent No.: US 10,864,972 B2
(45) Date of Patent: Dec. 15, 2020

(54) TRIM SYSTEM FOR A WATERCRAFT AND METHOD FOR CONTROLLING A TRIM OF A WATERCRAFT

(71) Applicant: BOMBARDIER RECREATIONAL PRODUCTS INC., Valcourt (CA)

(72) Inventors: Frederic Vachon, Granby (CA); Robert Kunanec, Bromont (CA)

(73) Assignee: BOMBARDIER RECREATIONAL PRODUCTS INC, Valcourt (CA)

( * ) Notice: Subject to any disclaimer, the term of this patent is extended or adjusted under 35 U.S.C. 154(b) by 0 days.

(21) Appl. No.: 16/457,214

(22) Filed: Jun. 28, 2019

(65) Prior Publication Data

US 2020/0001953 A1 Jan. 2, 2020

Related U.S. Application Data

(60) Provisional application No. 62/691,849, filed on Jun. 29, 2018.

(51) Int. Cl.

| | |
|---|---|
| ***B63H 11/04*** | (2006.01) |
| ***B63B 39/00*** | (2006.01) |
| ***B63B 34/10*** | (2020.01) |

(52) U.S. Cl.
CPC ..... *B63B 39/00* (2013.01); *B63B 34/10* (2020.02); *B63H 11/04* (2013.01)

(58) Field of Classification Search
CPC ..... B63H 11/04; B63B 39/00; B63B 34/10; B63B 34/00
See application file for complete search history.

(56) References Cited

U.S. PATENT DOCUMENTS

| | | | | |
|---|---|---|---|---|
| 5,507,672 | A * | 4/1996 | Imaeda | B63H 11/113 440/1 |
| 5,879,209 | A * | 3/1999 | Jones | B63B 39/00 440/42 |
| 6,533,623 | B2 | 3/2003 | Simard et al. | |
| 7,124,703 | B2 | 10/2006 | Richard et al. | |
| 7,674,144 | B2 | 3/2010 | Bourret et al. | |

(Continued)

OTHER PUBLICATIONS

Three Common PWC Handling Errors (and how to Correct Them). [online]. The Watercraft Journal, May 18, 2015 [retrieved on Jul. 15, 2020]. Retrieved from the Internet: https://watercraftjournal.com/three-common-pwc-handling-errors-and-how-to-correct-them/.

(Continued)

*Primary Examiner* — Stephen P Avila
(74) *Attorney, Agent, or Firm* — BCF LLP

(57) ABSTRACT

A trim system for a watercraft has a nozzle pivotable about a trim axis, a trim actuator operatively connected to the nozzle, at least one sensor for sensing at least one operating condition of the watercraft, a control unit electronically connected to the at least one sensor for receiving a sensor input signal indicative of the at least one operating condition. In a first trim control mode, the control unit controls the trim actuator to pivot the nozzle about the trim axis within a first range of trim angles. In a second trim control mode, the control unit controls the trim actuator to pivot the nozzle about the trim axis within a second range of trim angles. The first range of trim angles is greater than the second range of trim angles. A watercraft having a trim system and a method of controlling the trim are also disclosed.

20 Claims, 11 Drawing Sheets

(56) References Cited

U.S. PATENT DOCUMENTS

| | | | | |
|---|---|---|---|---|
| 7,708,609 | B2 | 5/2010 | Plante et al. | |
| 7,775,844 | B2 * | 8/2010 | St-Pierre | B63H 11/113 440/40 |
| 7,841,915 | B2 * | 11/2010 | Bourret | B63H 11/107 440/41 |
| 7,892,053 | B2 | 2/2011 | St-Pierre et al. | |
| 7,901,259 | B2 | 3/2011 | Bourret et al. | |
| 8,000,851 | B2 | 8/2011 | St-Pierre et al. | |
| 8,166,900 | B2 | 5/2012 | Kamio | |
| 8,177,592 | B2 | 5/2012 | Kamio | |
| 8,177,594 | B2 | 5/2012 | Dagenais et al. | |
| 8,202,136 | B2 | 6/2012 | Dagenais et al. | |
| 8,478,465 | B2 | 7/2013 | St-Pierre et al. | |
| 9,376,189 | B1 * | 6/2016 | De Henau | B63B 34/10 |
| 9,517,826 | B1 | 12/2016 | Leblond | |
| 9,682,757 | B1 | 6/2017 | Bourret | |
| 2012/0021659 | A1 | 1/2012 | Ota | |
| 2019/0071160 | A1 * | 3/2019 | Bylsma | B63H 20/10 |

OTHER PUBLICATIONS

Extended Range Variable Trim System (VTS). Datasheet [online]. BRP 2003-2002 [retrieved on Jul. 15, 2020]. Retrieved from the Internet: https://www.sea-doo.com/ca/en/shop/accessories/electrical_electroni/variable_trim_system/extended-range-variable-trim-system-vts.html.

2018 Operator's Guide; RTX / GTX / WAKE PRO Series. Bombardier Recreational Products Inc. et al. 2017.

* cited by examiner

TRIM SYSTEM FOR A WATERCRAFT AND METHOD FOR CONTROLLING A TRIM OF A WATERCRAFT

CROSS-REFERENCE

The present application claims priority to U.S. Provisional Patent Application No. 62/691,849, filed on Jun. 29, 2018, the entirety of which is incorporated herein by reference.

FIELD OF THE TECHNOLOGY

The present technology relates to trim systems for watercraft, watercraft having trim systems, and methods for controlling a trim angle of a watercraft.

BACKGROUND

There are many ways to propel a watercraft. One way is to use what is known as a jet propulsion system which is powered by a motor of the watercraft. The jet propulsion system typically consists of a jet pump and a venturi. The jet pump pressurizes water pumped from a body of water and expels it through the venturi as a jet directed rearwardly of the watercraft to create thrust. Usually, a nozzle is pivotally mounted rearwardly of the venturi for pivoting the nozzle about a steering axis. The nozzle is connected to a steering input of the watercraft which causes the nozzle to pivot left or right to redirect the jet of water and thereby steer the watercraft.

To allow trimming of the watercraft, the nozzle is usually also pivotable with respect to the venturi about a trim axis. The nozzle is connected to a trim input device of the watercraft which causes the nozzle to pivot upward to trim up positions or downward to trim down positions to redirect the jet of water accordingly. In a neutral trim position, the nozzle is aligned with the venturi for directing the jet of water rearwardly of the watercraft. In trim up positions, the nozzle is directed upwardly with respect to the venturi, thereby pushing down a stern of the watercraft and lifting a bow of the watercraft (i.e. trim up or positive trim). In the trim down positions, the nozzle is directed downwardly with respect to the venturi, thereby lifting the stern of the watercraft and pushing down the bow of the watercraft (i.e. trim down or negative trim).

A driver may want to adjust trim angle for a number of reasons. For example, reducing the trim angle can help get the watercraft on plane while increasing the trim angle can increase top speed. Also, reducing the trim angle when at speed can increase maneuverability and responsiveness to steering inputs by pushing the bow down and increasing the amount of hull in the water. Furthermore, adjusting the trim angle can help adapt the watercraft to various riding conditions (presence of passengers or other loads, wind, current) so as to ensure that it is at a riding attitude that does not cause porpoising.

Additionally, at least for personal watercraft, increasing the trim angle can increase playfulness at low speeds and can make it easier to perform certain maneuvers by making it easier to pop the bow of the watercraft up, out of the water. However, this is less desirable when operating the watercraft at high speed.

It would therefore be desirable to have a trim system for a watercraft that can control trim according to operating conditions of the watercraft.

SUMMARY

It is an object of the present technology to ameliorate at least some of the inconveniences present in the prior art.

According to one aspect of the present technology, there is provided a watercraft comprising a hull, a deck disposed on the hull, a motor disposed between the hull and the deck, and a jet propulsion system operatively connected to the motor and connected to the hull. The jet propulsion system comprises a jet pump operatively connected to the motor and a nozzle pivotally connected about a trim axis. The nozzle is disposed at least in part rearward of the jet pump. The nozzle is at least in part aligned with an outlet of the jet pump for selectively redirecting a jet of water expelled by the jet pump. A trim actuator is operatively connected to the nozzle for pivoting the nozzle about the trim axis. At least one sensor senses at least one operating condition of the watercraft. The at least one operating condition of the watercraft is at least one of watercraft speed, motor speed, motor speed input device position, water pressure in the jet propulsion system, and water flow speed in the jet propulsion system. A control unit is electronically connected to the at least one sensor for receiving a sensor input signal from the at least one sensor and to the trim actuator for controlling the trim actuator. The sensor input signal is indicative of the at least one operating condition. The control unit controls the trim actuator to pivot the nozzle about the trim axis in a selected one of at least a first trim control mode and a second trim control mode. In the first trim control mode, the control unit controls the trim actuator to pivot the nozzle about the trim axis within a first range of trim angles. In the second trim control mode, the control unit controls the trim actuator to pivot the nozzle about the trim axis within a second range of trim angles. The first range of trim angles is greater than the second range of trim angles. The control unit controls the trim actuator in the first trim control mode when the at least one operating condition is below a threshold value of the at least one operating condition until the at least one operating condition exceeds the threshold value. The control unit controls the trim actuator in the second trim control mode when the at least one operating condition is above the threshold value of the at least one operating condition.

In some embodiments, the first range of trim angles is defined between a first trim down angle and a first trim up angle. The second range of trim angles is defined between the first trim down angle and a second trim up angle. The first trim up angle is greater than the second trim up angle.

In some embodiments, the first trim down angle is a maximum trim down angle. The first trim up angle is a maximum trim up angle.

In some embodiments, the second trim up angle is half the first trim up angle.

In some embodiments, the watercraft comprises a driver-actuated trim input. The control unit is electronically connected to the driver-actuated trim input for receiving a trim input signal indicative of a desired trim setting. The control unit controls the trim actuator to pivot the nozzle about the trim axis based at least in part on the trim input signal. When the desired trim setting is above a threshold desired trim setting, the control unit controls the trim actuator to pivot the nozzle about the trim axis to a first trim angle when the control unit controls the trim actuator in the first trim control mode. The control unit controls the trim actuator to pivot the nozzle about the trim axis to a second trim angle when the control unit controls the trim actuator in the second trim control mode. The first trim angle is greater than the second trim angle.

In some embodiments, when the desired trim setting is below the threshold desired trim setting, the control unit controls the trim actuator to pivot the nozzle about the trim axis to a third trim angle when the control unit controls the trim actuator in the first trim control mode. The control unit controls the trim actuator to pivot the nozzle about the trim axis to a fourth trim angle when the control unit controls the trim actuator in the second trim control mode. The third trim angle is equal to the fourth trim angle.

In some embodiments, when the control unit controls the trim actuator in the second trim control mode and the at least one operating condition falls below the threshold value of the at least one operating condition, the control unit continues to control the trim actuator in the second trim control mode until the at least one operating condition has been below the threshold value of the at least one operating condition for a predetermined delay. The control unit returns to controlling the trim actuator in the first trim control mode when the at least one operating condition has been below the threshold value of the at least one operating condition for at least the predetermined delay.

In some embodiments, the at least one sensor is a watercraft speed sensor. The at least one operating condition is the watercraft speed.

In some embodiments, the nozzle is pivotally connected about a steering axis. The steering axis is perpendicular to the trim axis. The watercraft further comprises a steering actuator operatively connected to the nozzle for pivoting the nozzle about the steering axis.

In some embodiments, the jet propulsion system further comprises a trim support operatively pivotally connecting the nozzle to the jet pump. The trim support pivots with the nozzle about the trim axis. The nozzle pivots relative to the trim support about the steering axis.

According to another aspect of the present technology, there is provided a trim system for a watercraft comprising a nozzle adapted for being pivotally connected about a trim axis, a trim actuator operatively connected to the nozzle for pivoting the nozzle about the trim axis, and at least one sensor for sensing at least one operating condition of the watercraft. The at least one operating condition of the watercraft is at least one of watercraft speed, motor speed, motor speed input device position, water pressure in a jet propulsion system of the watercraft, and water flow speed in the jet propulsion system. The trim system comprises a control unit that is electronically connected to the at least one sensor for receiving a sensor input signal from the at least one sensor and to the trim actuator for controlling the trim actuator. The sensor input signal is indicative of the at least one operating condition. The control unit controls the trim actuator to pivot the nozzle about the trim axis in a selected one of at least a first trim control mode and a second trim control mode. In the first trim control mode, the control unit controls the trim actuator to pivot the nozzle about the trim axis within a first range of trim angles. In the second trim control mode, the control unit controls the trim actuator to pivot the nozzle about the trim axis within a second range of trim angles. The first range of trim angles is greater than the second range of trim angles. The control unit controls the trim actuator in the first trim control mode when the at least one operating condition is below a threshold value of the at least one operating condition until the at least one operating condition exceeds the threshold value. The control unit controls the trim actuator in the second trim control mode when the at least one operating condition is above the threshold value of the at least one operating condition.

In some embodiments, the first range of trim angles is defined between a first trim down angle and a first trim up angle. The second range of trim angles is defined between the first trim down angle and a second trim up angle. The first trim up angle is greater than the second trim up angle.

In some embodiments, the first trim down angle is a maximum trim down angle. The first trim up angle is a maximum trim up angle.

In some embodiments, the second trim up angle is half the first trim up angle.

In some embodiments, the trim system further comprises a driver-actuated trim input. The control unit is electronically connected to the driver-actuated trim input for receiving a trim input signal indicative of a desired trim setting. The control unit controls the trim actuator to pivot the nozzle about the trim axis based at least in part on the trim input signal. When the desired trim setting is above a threshold desired trim setting, the control unit controls the trim actuator to pivot the nozzle about the trim axis to a first trim angle when the control unit controls the trim actuator in the first trim control mode. The control unit controls the trim actuator to pivot the nozzle about the trim axis to a second trim angle when the control unit controls the trim actuator in the second trim control mode. The first trim angle is greater than the second trim angle.

In some embodiments, when the desired trim setting is below the threshold desired trim setting, the control unit controls the trim actuator to pivot the nozzle about the trim axis to a third trim angle when the control unit controls the trim actuator in the first trim control mode. The control unit controls the trim actuator to pivot the nozzle about the trim axis to a fourth trim angle when the control unit controls the trim actuator in the second trim control mode. The third trim angle is equal to the fourth trim angle.

In some embodiments, when the control unit controls the trim actuator in the second trim control mode and the at least one operating condition falls below the threshold value of the at least one operating condition, the control unit continues to control the trim actuator in the second trim control mode until the at least one operating condition has been below the threshold value of the at least one operating condition for a predetermined delay. The control unit returns to controlling the trim actuator in the first trim control mode when the at least one operating condition has been below the threshold value of the at least one operating condition for at least the predetermined delay.

In some embodiments, the at least one sensor is a watercraft speed sensor. The at least one operating condition is the watercraft speed.

In some embodiments, the trim system further comprises a trim support for operatively pivotally connecting the nozzle to a jet pump of the watercraft. The trim support pivots with the nozzle about the trim axis. The nozzle pivots relative to the trim support about a steering axis. The steering axis is perpendicular to the trim axis. A steering actuator is operatively connected to the trim support for pivoting the trim support and the nozzle about the steering axis.

According to another aspect of the present technology, there is provided a method for controlling a trim of a watercraft comprising sensing at least one operating condition of the watercraft. The at least one operating condition of the watercraft is at least one of watercraft speed, motor speed, motor speed input device position, water pressure in a jet propulsion system of the watercraft, and water flow speed in the jet propulsion system. The method comprises controlling a trim actuator to pivot a nozzle of a jet propulsion system of the watercraft about a trim axis in a first trim control mode when the at least one operating condition is below a threshold value of the at least one operating condition until the at least one operating condition exceeds the threshold value. The method comprises controlling the trim actuator to pivot the nozzle about the trim axis in the second trim control mode when the at least one operating condition is above the threshold value of the at least one operating condition. In the first trim control mode, the trim actuator is controlled to pivot the nozzle about the trim axis within a first range of trim angles. In the second trim control mode, the trim actuator is controlled to pivot the nozzle about the trim axis within a second range of trim angles. The first range of trim angles is greater than the second range of trim angles.

In some embodiments, the first range of trim angles is defined between a first trim down angle and a first trim up angle. The second range of trim angles is defined between the first trim down angle and a second trim up angle. The first trim up angle is greater than the second trim up angle.

In some embodiments, the method further comprises determining a desired trim setting from a driver-actuated trim input. Based at least in part on the desired trim setting, when the desired trim setting is above a threshold desired trim setting, controlling the trim actuator in the first trim control mode controls the trim actuator to pivot the nozzle about the trim axis to a first trim angle, and controlling the trim actuator in the second trim control mode controls the trim actuator to pivot the nozzle about the trim axis to a second trim angle. The first trim angle is greater than the second trim angle.

In some embodiments, based at least in part on the desired trim setting, when the desired trim setting is below the threshold desired trim setting, controlling the trim actuator in the first trim control mode controls the trim actuator to pivot the nozzle about the trim axis to a third trim angle. Controlling the trim actuator in the second trim control mode controls the trim actuator to pivot the nozzle about the trim axis to a fourth trim angle. The third trim angle is equal to the fourth trim angle.

In some embodiments, the method comprises, when the trim actuator is controlled in the second trim control mode, determining if the at least one operating condition falls below the threshold value of the at least one operating condition. The method comprises, if the at least one operating condition falls below the threshold value of the at least one operating condition, continuing to control the trim actuator in the second trim control mode until the at least one operating condition has been below the threshold value of the at least one operating condition for a predetermined delay, and returning to control the trim actuator in the first trim control mode when the at least one operating condition has been below the threshold value of the at least one operating condition for at least the predetermined delay.

In some embodiments, the at least one operating condition is watercraft speed.

For purposes of this application, terms related to spatial orientation such as forward, rearward, upward, downward, left, and right, are as they would normally be understood by a driver of the watercraft sitting thereon in a normal driving position. Terms related to spatial orientation when referring to the jet propulsion system alone and components thereof should be understood as they would normally be understood when the jet propulsion system is installed on a watercraft. The explanations of terms provided herein take precedence over explanations of these terms that may be found in the document incorporated herein by reference.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of embodiments of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Embodiments of a trim system 150 according to the present technology will be described in combination with a personal watercraft 10. However, it is contemplated that embodiments of the present trim system 150 could be used with other types of jet propelled watercraft.

The general construction of the personal watercraft 10 will be described with respect to FIGS. 1 to 5. The following description relates to one way of manufacturing a personal watercraft. Those of ordinary skill in the watercraft art should recognize that there are other known ways of manufacturing and designing personal watercraft and that these are contemplated.

Figure 1:
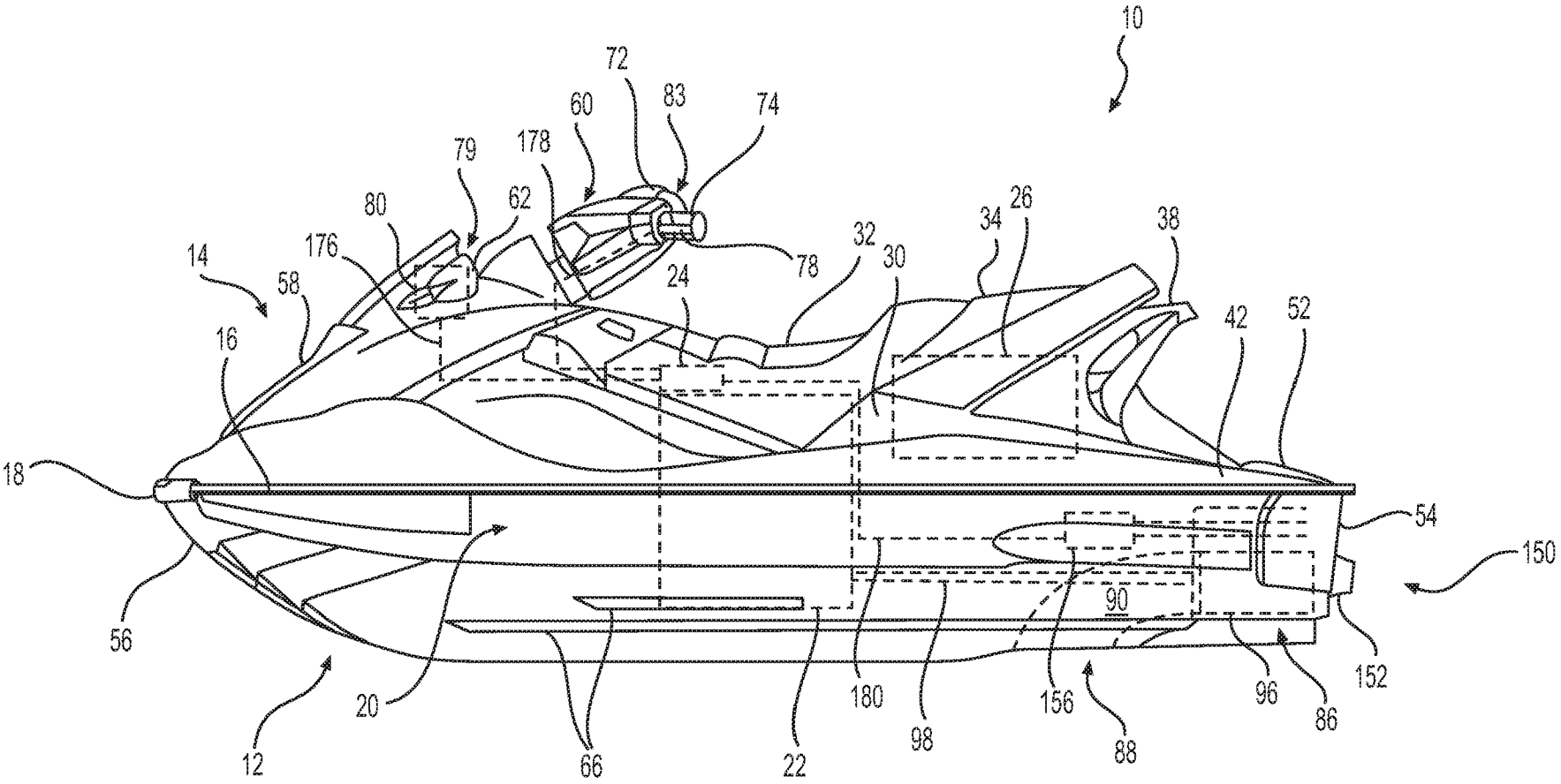
FIG. 1 is a left side elevation view of a personal watercraft.

The personal watercraft 10 of FIG. 1 includes a hull 12 and a deck 14. The hull 12 comprises a bow 56 and a transom 54 (i.e. a stern), respectively defining forward and rear portions of the hull 12. The hull 12 buoyantly supports the watercraft 10 in the water. The deck 14 is designed to accommodate a rider and one or more passengers. The hull 12 and deck 14 are joined together at a seam 16 that joins the parts in a sealing relationship. The seam 16 comprises a bond line formed by an adhesive. Other known joining methods could be used to sealingly engage the hull 12 and deck 14 together, including but not limited to thermal fusion, molding or fasteners such as rivets or screws. A bumper 18 generally covers the seam 16, which helps to prevent damage to the outer surface of the watercraft 10 when the watercraft 10 is docked, for example. The bumper 18 can extend around the bow 56, as shown, or around any portion or the entire seam 16.

The space between the hull 12 and the deck 14 forms a volume commonly referred to as the motor compartment 20. The motor compartment 20 accommodates a motor 22 (shown schematically in FIG. 1), a battery, an electronic control unit 24 (ECU, some functions of which will be described in further detail below), and other elements required or desirable in the watercraft 10. In the present embodiment, the motor 22 is an internal combustion engine, and the motor compartment 20 further accommodates a fuel tank, an air intake system and an exhaust system. In an alternative embodiment, the ECU 24 is formed by multiple electronic units located in different positions within the personal watercraft 10 that together provide the functions of the ECU 24.

Figure 2:
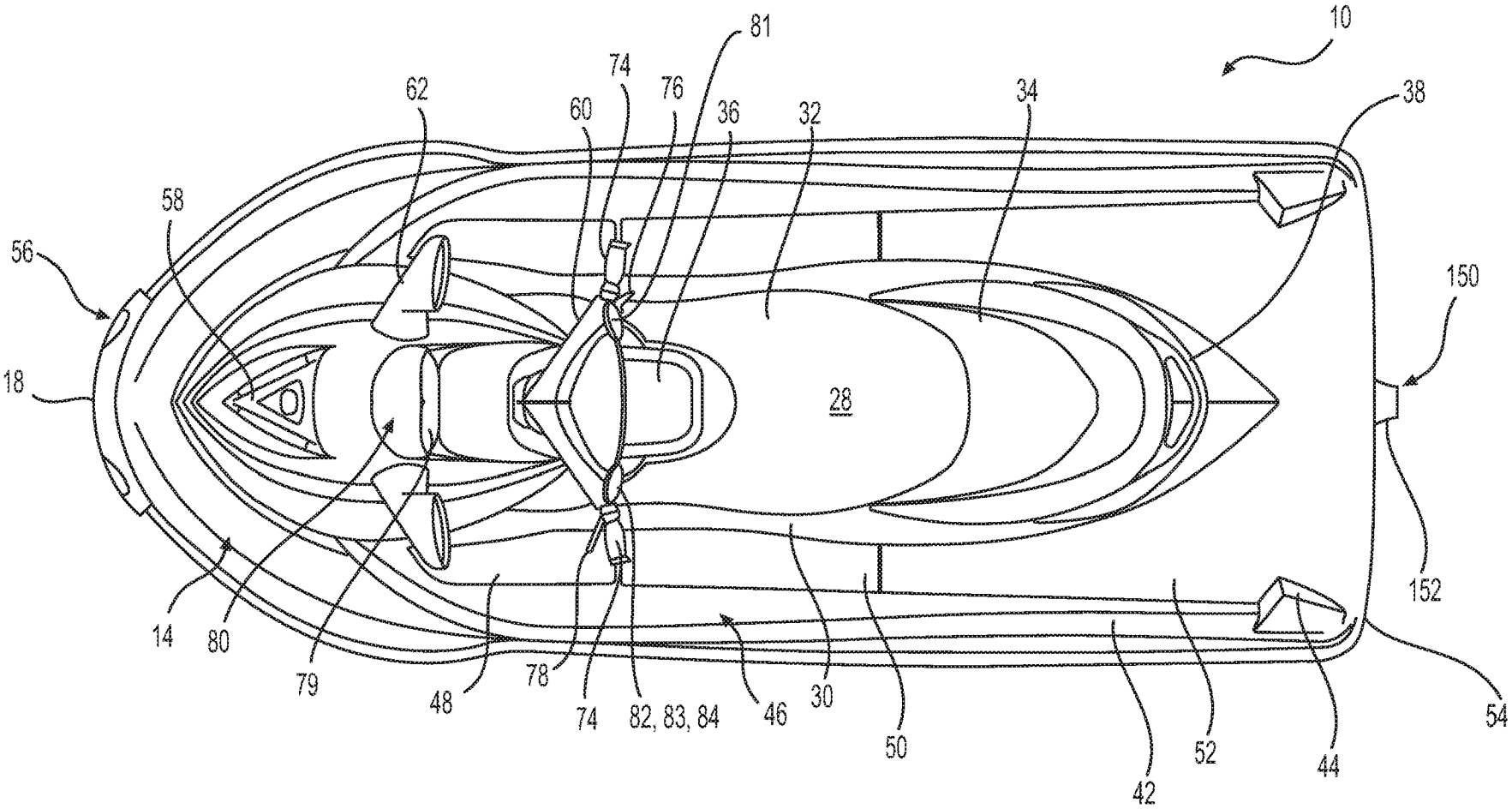
FIG. 2 is a top plan view of the personal watercraft of FIG. 1.

As seen in FIGS. 1 and 2, the deck 14 has a centrally positioned straddle-type seat 28 positioned on top of a pedestal 30 to accommodate a driver and one or more passengers in a straddling position. The seat 28 includes a front seat portion 32 and a rear, raised seat portion 34. The front and rear seat portions 32, 34 are removably attached to the pedestal 30 by a hook and tongue assembly (not shown) at the front of each seat portion and by a latch assembly (not shown) at the rear of each seat portion, or by any other known attachment mechanism. The seat portions 32, 34 can be individually tilted or removed completely. One of the seat portions 32, 34 covers a motor access opening (in this case above motor 22) defined by a top portion of the pedestal 30 to provide access to the motor 22 (FIG. 1). The other seat portion (in this case portion 34) covers a removable storage box 26 (FIG. 1). It is contemplated that the seat 28 could be a single seat element. It is also contemplated that the seat 28 could be sized to accommodate only a driver or a driver and only one passenger. A storage box 36 is provided in front of the seat 28.

A grab handle 38 is provided between the pedestal 30 and the rear of the seat 28 to provide a handle onto which a passenger may hold. This arrangement is particularly convenient for a passenger seated facing backwards for spotting a water skier, for example. Beneath the handle 38, a tow hook 40 is mounted on the pedestal 30. The tow hook 40 can be used for towing a skier or floatation device, such as an inflatable water toy.

Figure 4:
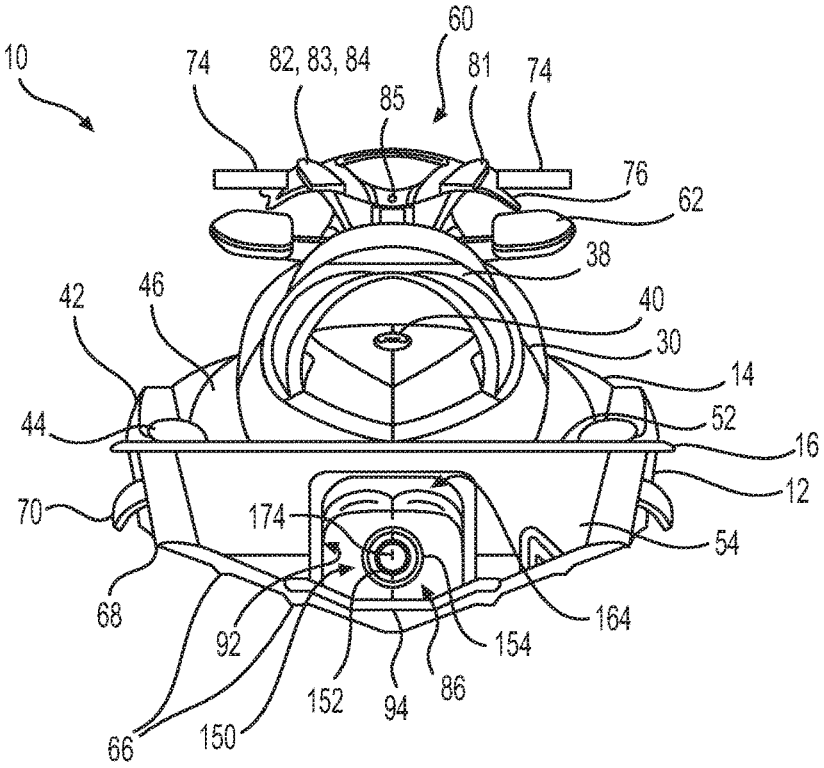
FIG. 4 is a rear elevation view of the personal watercraft of FIG. 1.

As best seen in FIGS. 2 and 4, the watercraft 10 has a pair of generally upwardly extending walls located on either side of the watercraft 10 known as gunwales or gunnels 42. The gunnels 42 help to prevent the entry of water in the footrests 46 of the watercraft 10, provide lateral support for the riders' feet, and also provide buoyancy when turning the watercraft 10, since personal watercraft roll slightly when turning. Towards the rear of the watercraft 10, the gunnels 42 extend inwardly to act as heel rests 44. Heel rests 44 allow a passenger riding the watercraft 10 facing towards the rear for spotting a water-skier for example, to place his or her heels on the heel rests 44. Heel rests 44 could also be formed separate from the gunnels 42.

Located on both sides of the watercraft 10, between the pedestal 30 and the gunnels 42 are the footrests 46. The footrests 46 are designed to accommodate a rider's feet in various riding positions. To this effect, the footrests 46 each have a forward portion 48 angled such that the front portion of the forward portion 48 (toward the bow 56 of the watercraft 10) is higher, relative to a horizontal reference point, than the rear portion of the forward portion 48. The remaining portions of the footrests 46 are generally horizontal. Of course, any contour conducive to a comfortable rest for the riders' feet could be used. The footrests 46 are covered by carpeting 50 made of a rubber-type material, for example, to provide additional comfort and traction for the feet of the riders.

A reboarding platform 52 is provided at the rear of the watercraft 10 on the deck 14 to allow the driver or a passenger to easily reboard the watercraft 10 from the water. Carpeting or some other suitable covering covers the reboarding platform 52. A retractable ladder (not shown) may be affixed to the transom 54 to facilitate boarding the watercraft 10 from the water onto the reboarding platform 52.

Figure 3:
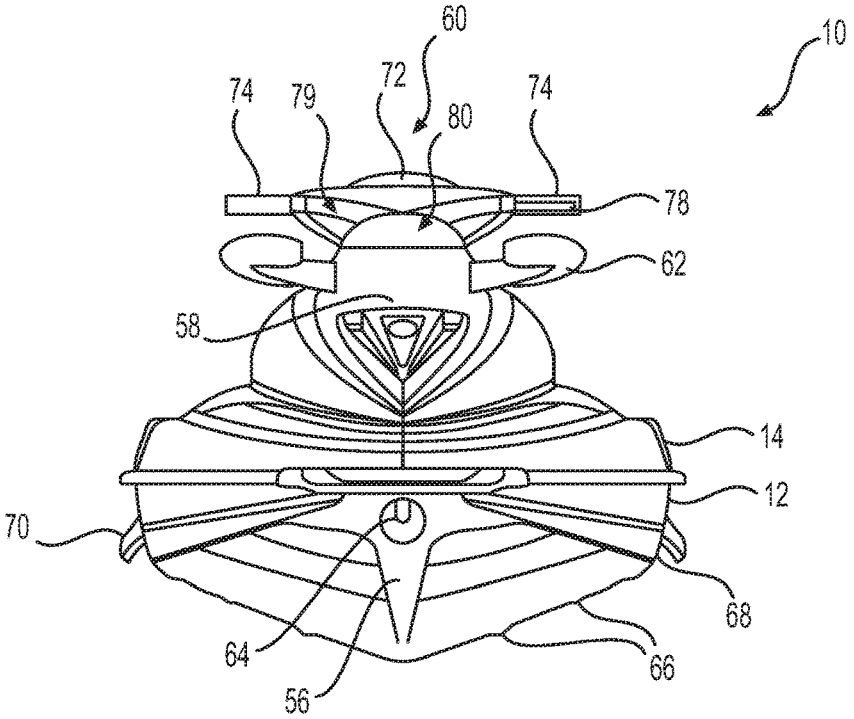
FIG. 3 is a front elevation view of the personal watercraft of FIG. 1.

Referring to the bow 56 of the watercraft 10, as seen in FIGS. 2 and 3, the watercraft 10 is provided with a hood 58 located forwardly of the seat 28 and a steering assembly including a helm assembly 60. A hinge (not shown) is attached between a forward portion of the hood 58 and the deck 14 to allow the hood 58 to move to an open position to provide access to a front storage bin (not shown). A latch (not shown) located at a rearward portion of the hood 58 locks the hood 58 into a closed position to prevent water from entering the front storage bin. Rearview mirrors 62 are positioned on either side of the hood 58 to allow the rider to see behind the watercraft 10. A hook 64 is located at the bow 56 of the watercraft 10. The hook 64 is used to attach the watercraft 10 to a dock when the watercraft 10 is not in use or to attach to a winch when loading the watercraft 10 on a trailer for instance.

Figure 5:
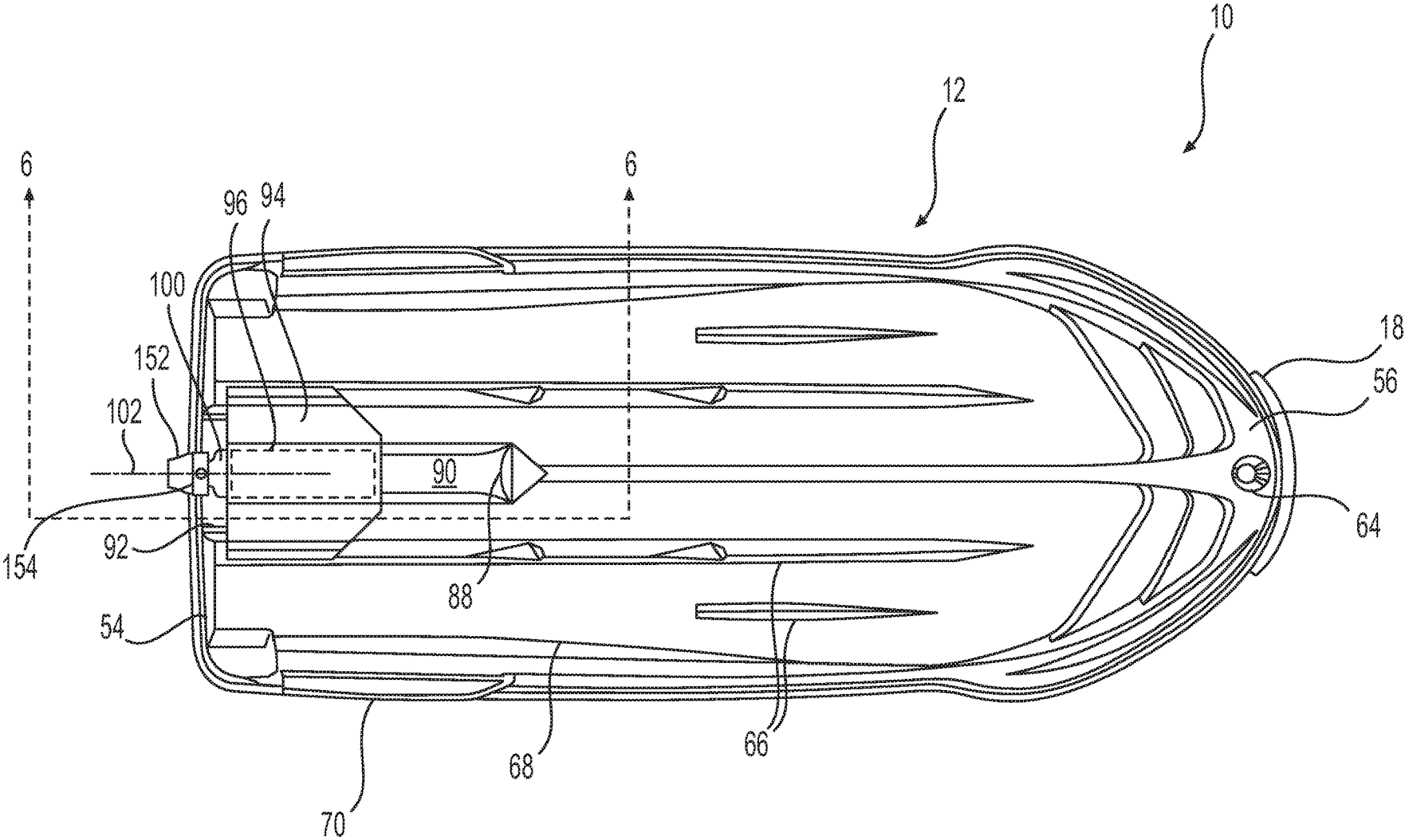
FIG. 5 is a bottom plan view of the personal watercraft of FIG. 1.

As best seen in FIGS. 3, 4, and 5, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics.

Sponsons 70 are located on both sides of the hull 12 near the transom 54. The sponsons 70 have an arcuate undersurface that gives the watercraft 10 both lift while in motion and improved turning characteristics. The sponsons 70 are fixed to the surface of the hull 12 and can be attached to the hull 12 by fasteners or molded therewith. It is contemplated that the position of the sponsons 70 could be adjusted with respect to the hull 12 to change the handling characteristics of the watercraft 10 and to accommodate different riding conditions.

As best seen in FIGS. 1 and 2, the helm assembly 60 is positioned forwardly of the seat 28. The helm assembly 60 has a central helm portion 72 that may be padded, and a pair of steering handles 74, also referred to as a handlebar. The right steering handle 74 is provided with a motor speed input device 76, which allows the driver to control the speed of the motor 22, and therefore the speed of the watercraft 10. The motor speed input device 76 can be in the form of, but not limited to, a thumb-actuated lever (as shown), a finger-actuated lever, or a twist grip. The motor speed input device 76 is movable between an idle position and multiple actuated positions. The motor speed input device 76 is biased towards the idle position, such that when the driver of the watercraft 10 lets go of the motor speed input device 76, it moves to the idle position. The left steering handle 74 is provided with a lever 78 used by the driver to control deceleration and reverse operation of the watercraft 10. It is contemplated that the lever 78 could be omitted.

As schematically shown in FIGS. 2 and 3, a display area or cluster 79 is located forwardly of the helm assembly 60. The display cluster 79 can be of any conventional display type, including, but not limited to, a liquid crystal display (LCD), dials or LED (light-emitting diodes). A global positioning system (GPS) 80 is connected to the display cluster 79 and is housed in its vicinity. When the watercraft 10 is operated, the GPS 80 receives a satellite signal indicative of the position of the watercraft 10. By comparing this position over time, the GPS 80 computes the speed of the watercraft 10. As such, the GPS 80 acts as a speed sensor of the watercraft 10. The GPS 80 sends a sensor input signal, in this case a signal indicative of the speed of the watercraft 10, to the ECU 24. As will be described below, the ECU 24 uses this sensor input signal received from the GPS 80 to control the trim system 150 of the watercraft 10. In an alternative embodiment, a speed sensor in the form of a paddle wheel attached to the transom 54 of the watercraft 10 is used to send the signal indicative of the speed of the watercraft 10 to the ECU 24 instead of the GPS 80. It is also contemplated that such a speed sensor could be used as a backup to the GPS 80 for determining the speed of the watercraft 10. Other types of speed sensors are contemplated.

Turning now to FIGS. 2 and 4, a right cluster of buttons 81 is located laterally inward of the right steering handle 74 and adjacent to the central helm portion 72. The buttons 81 could alternatively be in the form of levers or switches. The buttons 81 allow the driver to control display parameters of operating condition data (e.g. watercraft speed, motor RPM, GPS data, selected trim setting) on the display cluster 79 or to control operating parameters of the watercraft 10. A left cluster of buttons 82 is located laterally inward of the left steering handle 74 and adjacent to the central helm portion 72. The buttons 82 could alternatively be in the form of levers or switches. The buttons 82 include a start/stop button 84. The left cluster of buttons 82 also includes buttons that form an interface of a driver-actuated trim input device 83 for sending a trim input signal indicative of a desired trim setting to the ECU 24, as will be described below. It is contemplated that in some embodiments, the trim input device 83 could be located elsewhere on the watercraft 10. It is also contemplated that the trim input signal could be sent otherwise to the ECU 24.

The helm assembly 60 also has a key receiving post 85 located near a center of the central helm portion 72. The key receiving post 85 is adapted to receive a key (not shown) that is used to authorize starting of the watercraft 10. The key is typically attached to a safety lanyard (not shown). Once the key is connected to the key receiving post 85, pressing the start/stop button 84 will start the motor 22. Pressing the start/stop button 84 again or disconnecting the key from the key receiving post 85 will stop the motor 22. It should be noted that the key receiving post 85 may be placed in any suitable location on the watercraft 10. In one embodiment, the key receiving post 85 includes a key communication terminal capable of detecting a key proximity signal emitted by the key for starting the watercraft 10 without requiring physical contact between the key and the key receiving post 85. Also, the key receiving post 85 is connected to the ECU 24 for sending a key setting signal indicative of watercraft operating parameter settings associated with the key. As non-limiting examples, watercraft operating parameters include maximum watercraft speed and trim control mode, for which settings may be stored on the key for driver convenience or for driver training purposes. As such, when a key such as a Learning Key™ from Sea-Doo™ is used for storing selected watercraft operating parameter settings, the ECU 24 receives the key setting signal and controls operation of the watercraft 10 according to the stored settings. It is contemplated that multiple keys (e.g. a Learning Key™ and a normal key) can be used with the watercraft 10.

Figure 6:
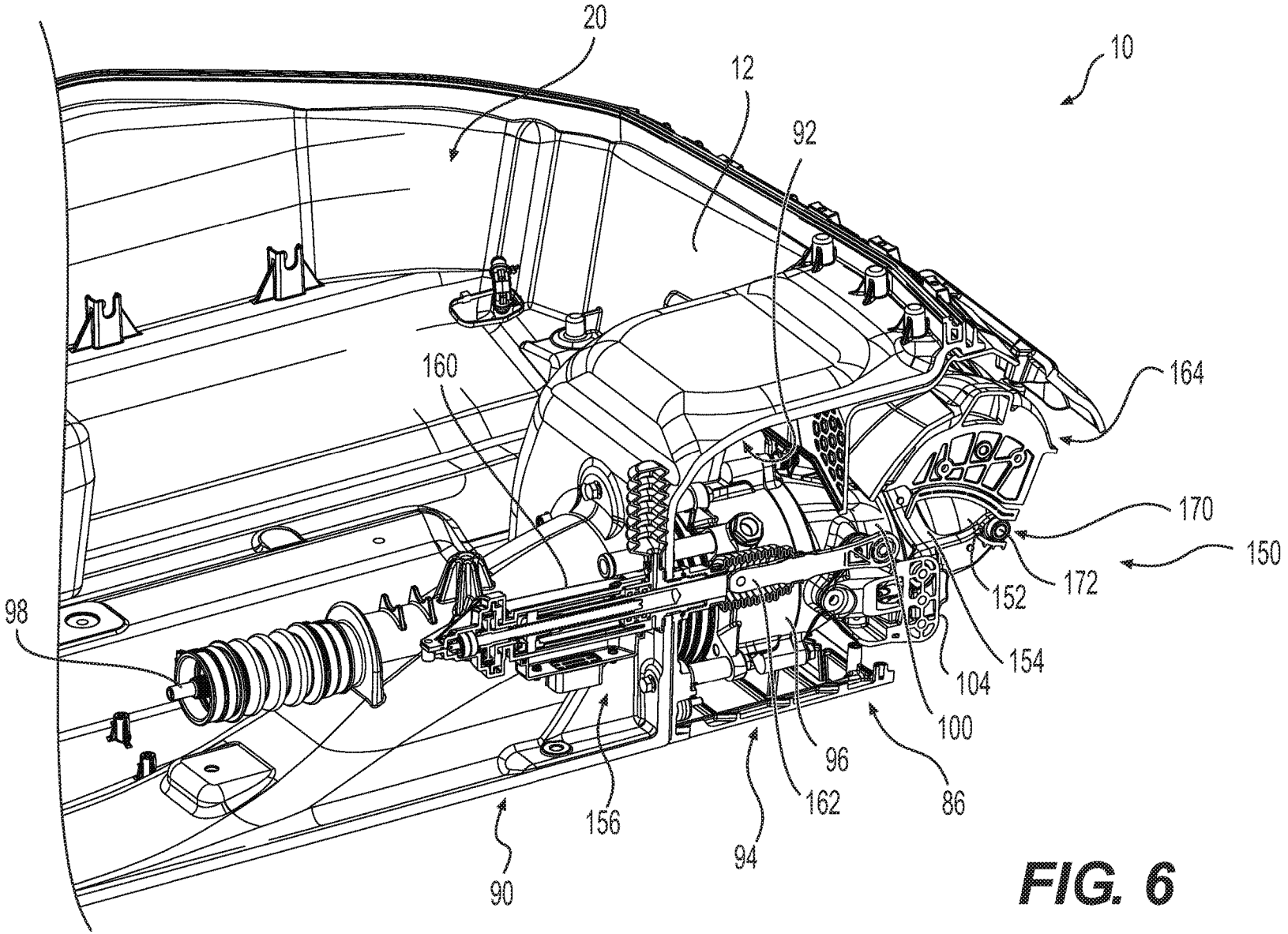
FIG. 6 is a perspective cross-sectional view of the watercraft of FIG. 1 taken through line 6-6 of FIG. 5 with a deck of the watercraft being removed.
Figure 7:
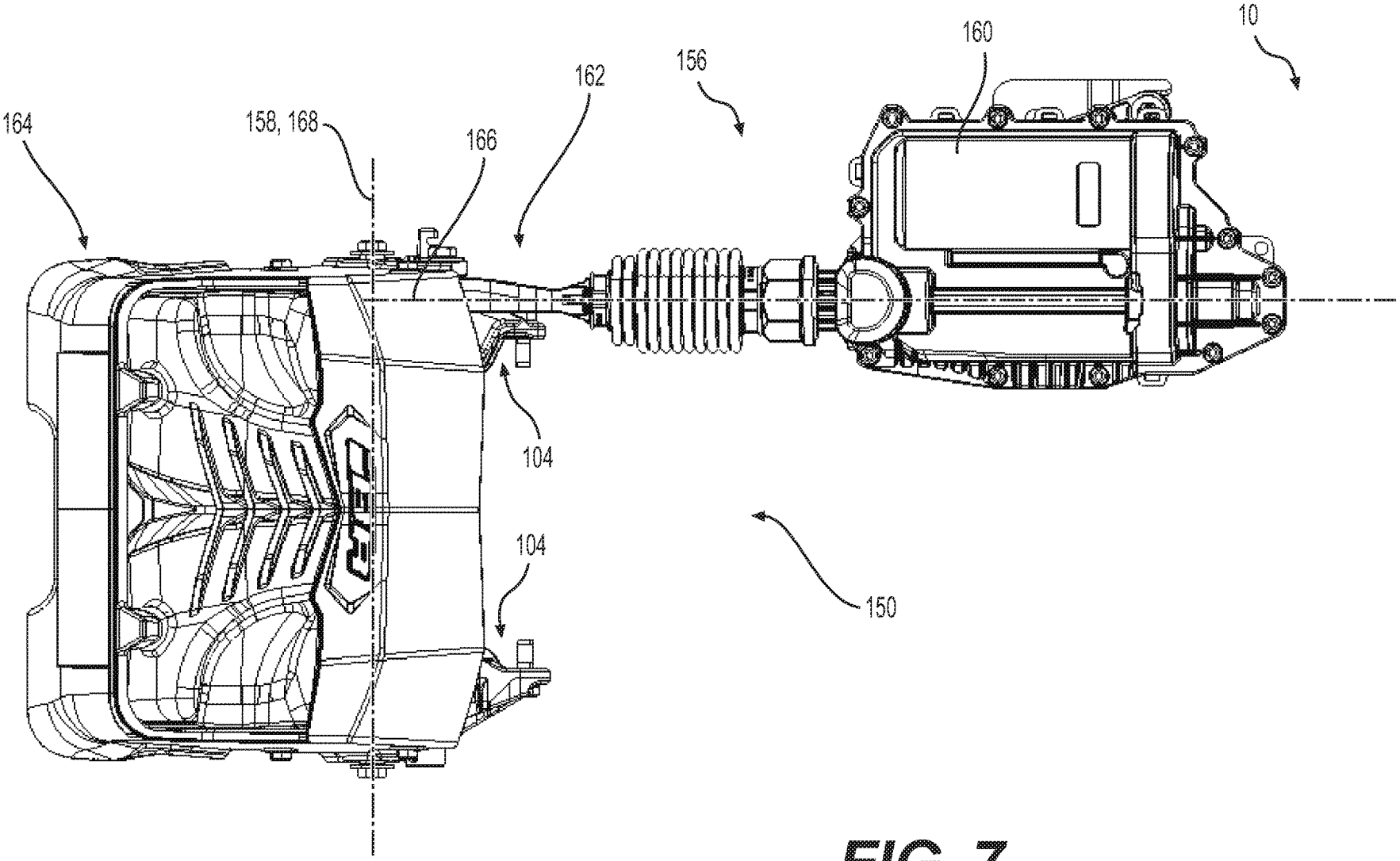
FIG. 7 is a top plan view of components of the trim system and the jet propulsion system of FIG. 6.
Figure 8:
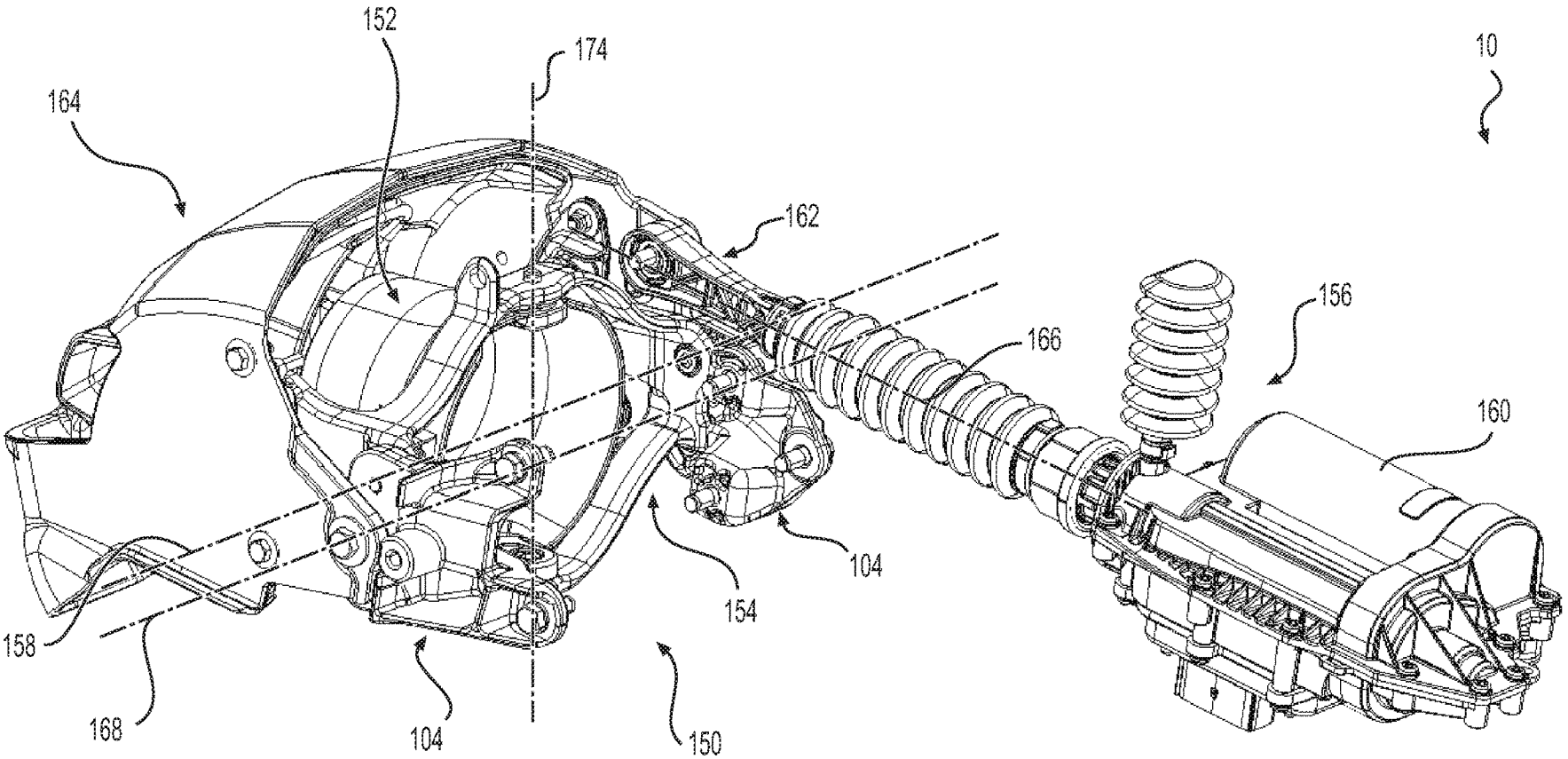
FIG. 8 is a perspective view taken from a front, right, top side of the components of the trim system and the jet propulsion system of FIG. 6.
Figure 9:
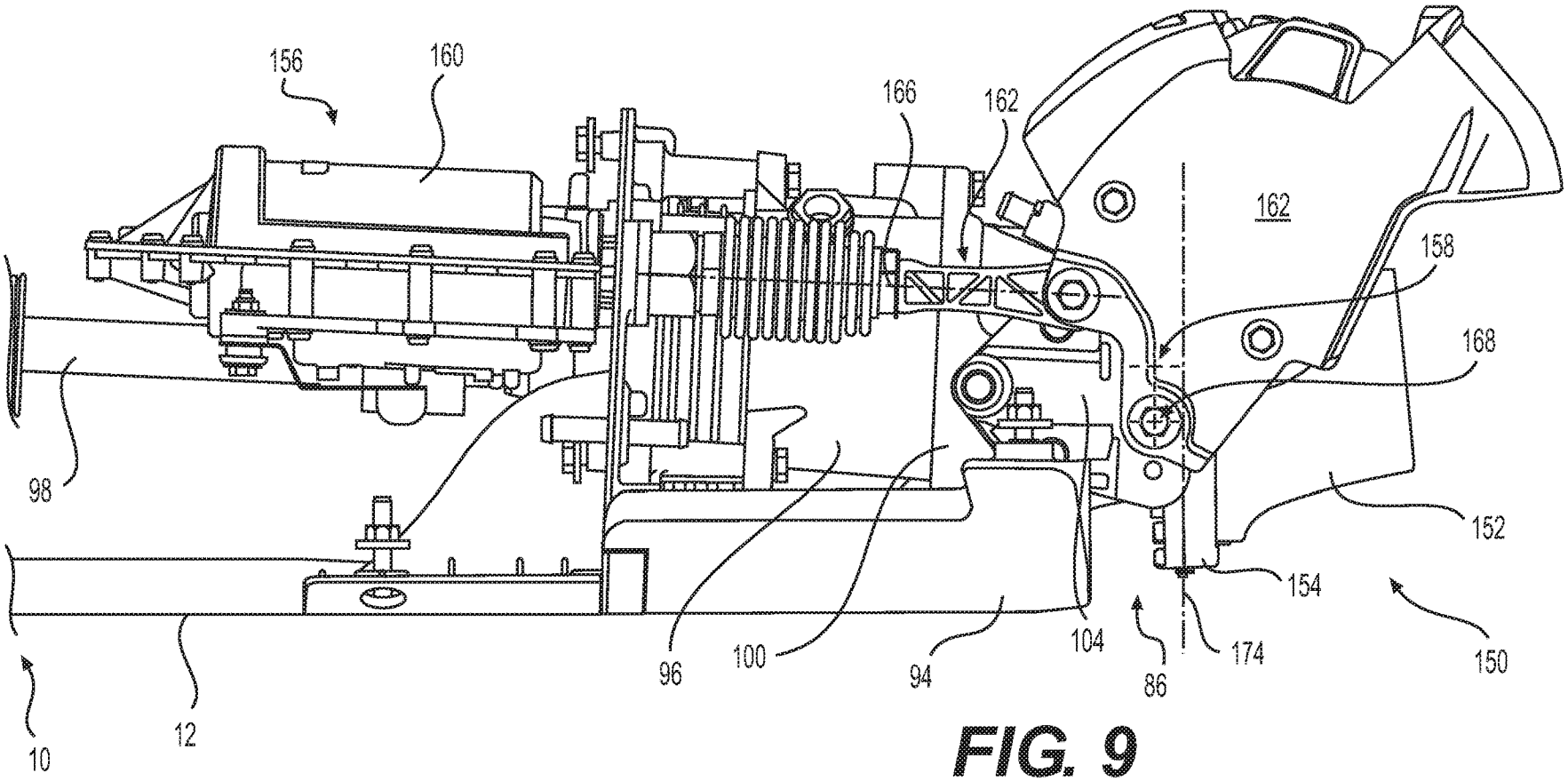
FIG. 9 is a left side elevation view of the components of the trim system and the jet propulsion system of FIG. 6, with a nozzle of the trim system being positioned in a trim up angle.

The watercraft 10 is propelled by a jet propulsion system 86 which will now be described with reference to FIGS. 1 and 4 to 9. The jet propulsion system 86 pressurizes water to create thrust. The water is first scooped from under the hull 12 through an inlet 88, which has a grate (not shown in detail). The inlet grate prevents large rocks, weeds, and other debris from entering the jet propulsion system 86, which may otherwise damage the jet propulsion system 86 or negatively affect its performance in the absence of an inlet grate. Water flows from the inlet 88 to a water intake ramp 90. A top portion of the water intake ramp 90 is formed by the hull 12, and a ride shoe (not shown in detail) forms a bottom portion of the water intake ramp 90. Alternatively, the intake ramp 90 may be a single piece or an insert to which the jet propulsion system 86 attaches. In such cases, the intake ramp 90 and the jet propulsion system 86 are attached as a unit in a recess in the bottom of hull 12. As best seen in FIG. 4, the jet propulsion system 86 is located in a concave formation of the hull 12, referred to as a tunnel 92. The tunnel 92 is defined at the front, sides, and top by the hull 12 and is open at the transom 54. The bottom of the tunnel 92 is closed by a ride plate 94, on which the watercraft 10 rides or planes when the watercraft 10 is operated at high speeds. From the intake ramp 90, water enters a jet pump 96 (schematically shown in FIGS. 1 and 5, best seen in FIGS. 6 and 9) of the jet propulsion system 86. The jet pump 96 includes an impeller (not shown) coupled to the motor 22 by one or more shafts 98 for rotation of the impeller, thereby pressurizing water within the jet pump 96. Water is expelled from the jet pump 96 into a venturi 100 (FIG. 6). Water then exits the venturi 100 as a jet expelled rearward along a jet axis 102 (FIG. 5). Side brackets 104 (best seen on FIG. 8) located on each side of the venturi 100 serve as connection between the jet propulsion system 86 and the trim system 150, as will be described in further detail below. Although the jet propulsion system 86 is disposed forward of the transom 54 in the tunnel 92 of the watercraft 10, it is contemplated that the jet propulsion system 86 could also be mounted directly to the transom 54.

With reference to FIGS. 6 to 9, the mechanical components of the trim system 150 will now be described. The trim system 150 comprises a nozzle 152, a trim support 154 and a trim actuator 156. The nozzle 152 is pivotally connected to the trim support 154 about a steering axis 174, and the trim support 154 is pivotally connected to the side brackets 104 about a trim axis 158. The steering axis 174 is perpendicular to the trim axis 158. The trim actuator 156 is indirectly connected to the trim support 154 for pivoting the trim support 154 with the nozzle 152 about the trim axis 158 as will be described in more detail below. A separate actuator (not shown) is connected to the nozzle 152 for pivoting the nozzle 152 about the steering axis 174. The jet of water expelled from the venturi 100 passes through the nozzle 152. The nozzle 152 redirects this jet of water left or right as it pivots about the steering axis 174 to steer the watercraft 10. The nozzle 152 redirects this jet of water up or down as it pivots about the trim axis 158 to trim the watercraft 10.

More specifically, the trim actuator 156 is an electrical linear actuator 156, and includes an actuator housing 160 disposed in the motor compartment 20. The linear actuator 156 also includes an electrical actuator motor (not shown)

disposed in the housing 160 and an actuator arm 162. The actuator arm 162 is connected at its front end to the actuator motor. The actuator arm 162 extends rearward of the actuator housing 160 and is connected at its rear end to a reverse gate 164. The reverse gate 164 is pivotally connected to the brackets 104 about a reverse gate axis 168. The actuator motor imparts linear motion to the actuator arm 162 along an actuation axis 166 for pulling or pushing on the reverse gate 164. This causes the reverse gate 164 to pivot upward or downward about a reverse gate axis 168. Thus, in the present embodiment, the trim actuator 156 is also a reverse gate actuator.

Figure 10:
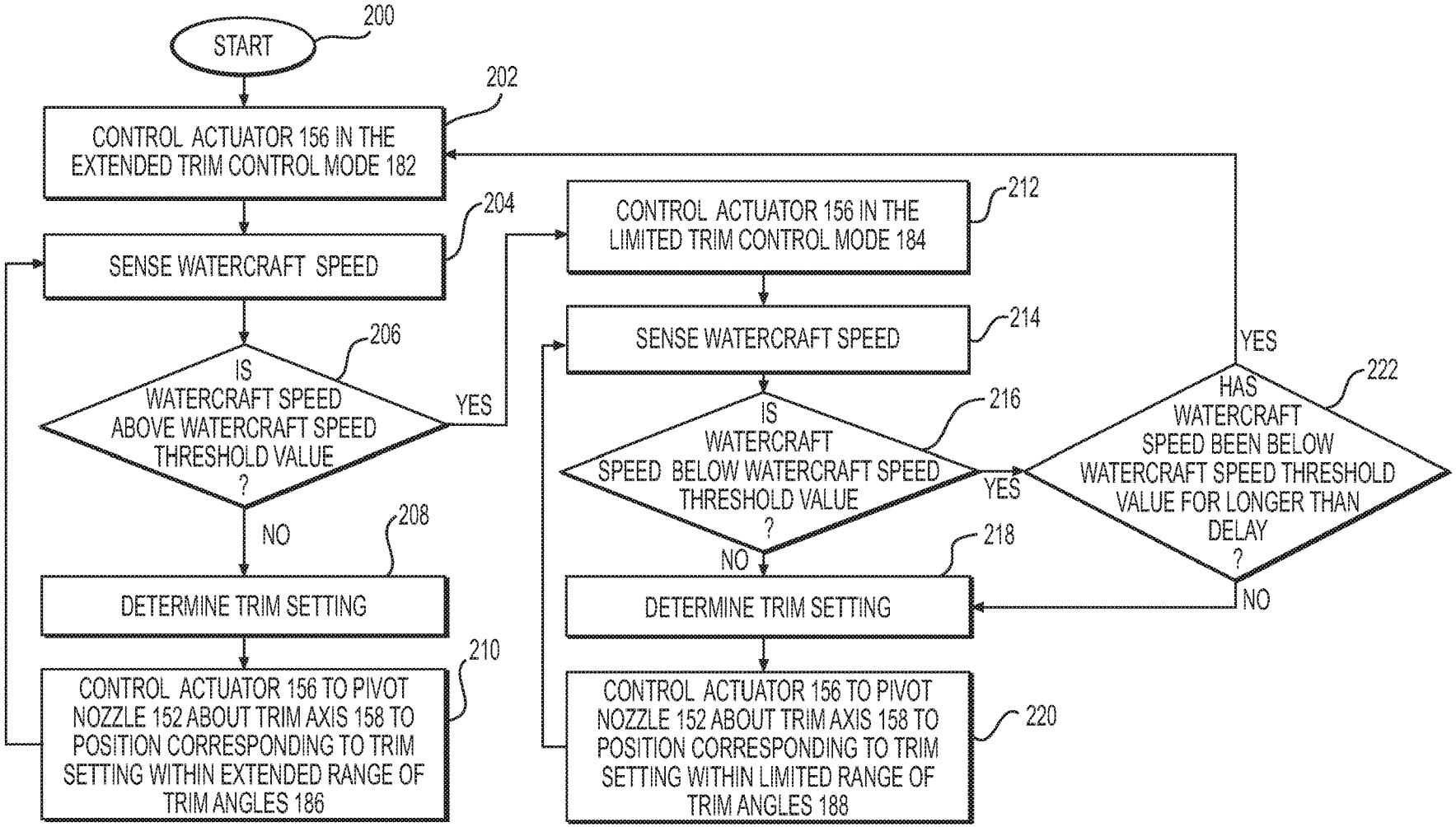
FIG. 10 is a flowchart illustrating a method of controlling a trim of a watercraft.

Rotation of the reverse gate 164 about the reverse gate axis 168 causes rotation of the trim support 154 about the trim axis 158. Tracks 170 of the reverse gate 164 and followers 172 of the trim support 154 are structured and arranged so as to cause the trim support 154, and therefore the nozzle 152, to pivot upward or downward about the trim axis 158 when the reverse gate 164 pivots upward or downward about the reverse gate axis 168. When the reverse gate 164 is at its fully raised position, the nozzle 152 is at its maximum trim up angle 192 (FIG. 10) and the reverse gate 164 does not interfere with the jet of water expelled from the nozzle 152. From this position, as the trim actuator 156 causes the reverse gate 164 to pivot downward about the reverse gate axis 168, the nozzle 152 pivots downward about the trim axis 158 until the nozzle 152 reaches its maximum trim down angle 190 (FIG. 10). As the nozzle 152 pivots between the maximum trim up and trim down angles 192, 190, the reverse gate 164 does not interfere with the jet of water expelled from the nozzle 152. Once the nozzle 152 reaches the maximum trim down angle 190, continued downward rotation of the reverse gate 164 causes the reverse gate 164 to interfere with the jet of water expelled from the nozzle 152 redirecting first downward and eventually partly forward to decelerate the watercraft 10 or cause the watercraft 10 to move in reverse while the nozzle 152 stays at the maximum trim down angle 190. When the actuator 156 causes the reverse gate 164 to pivot upward about the reverse gate axis 168, the nozzle 152 remains at the maximum trim down angle 190 until the reverse gate 164 no longer interferes with the jet of water expelled from the nozzle 152, at which point the nozzle 152 pivots upward about the trim axis 158 as the reverse gate 164 continues to pivot upward about the reverse gate axis 168. Additional details regarding the mechanical components of the trim system 150 may be found in U.S. Pat. No. 9,376,189 B1, issued Jun. 28, 2016, the entirety of which is incorporated herein by reference. In this embodiment, a single actuator 156 is used to pivot of the nozzle 152 about the trim axis 158 and the reverse gate 164 about the reverse gate axis 168, but it is contemplated that, in some embodiments, the trim support 154 could be operatively connected to the trim actuator 156 independently of the reverse gate 164 and that the reverse gate 164 could be provided with its own separate actuator.

Figure 11:
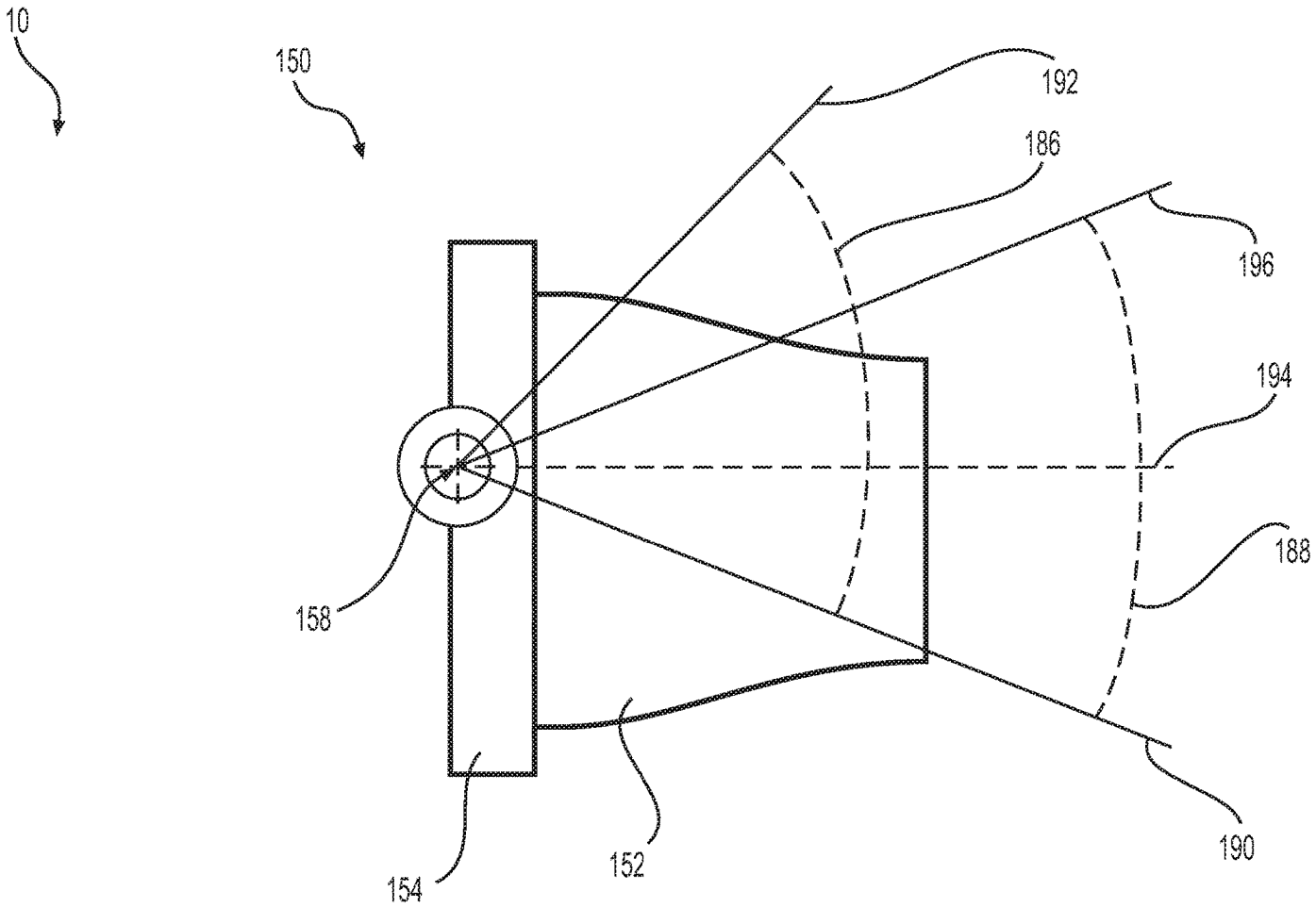
FIG. 11 is a schematic left side elevation view of a trim support and the nozzle of the trim system of FIG. 6 illustrating various trim positions of the nozzle.
Figure 12:
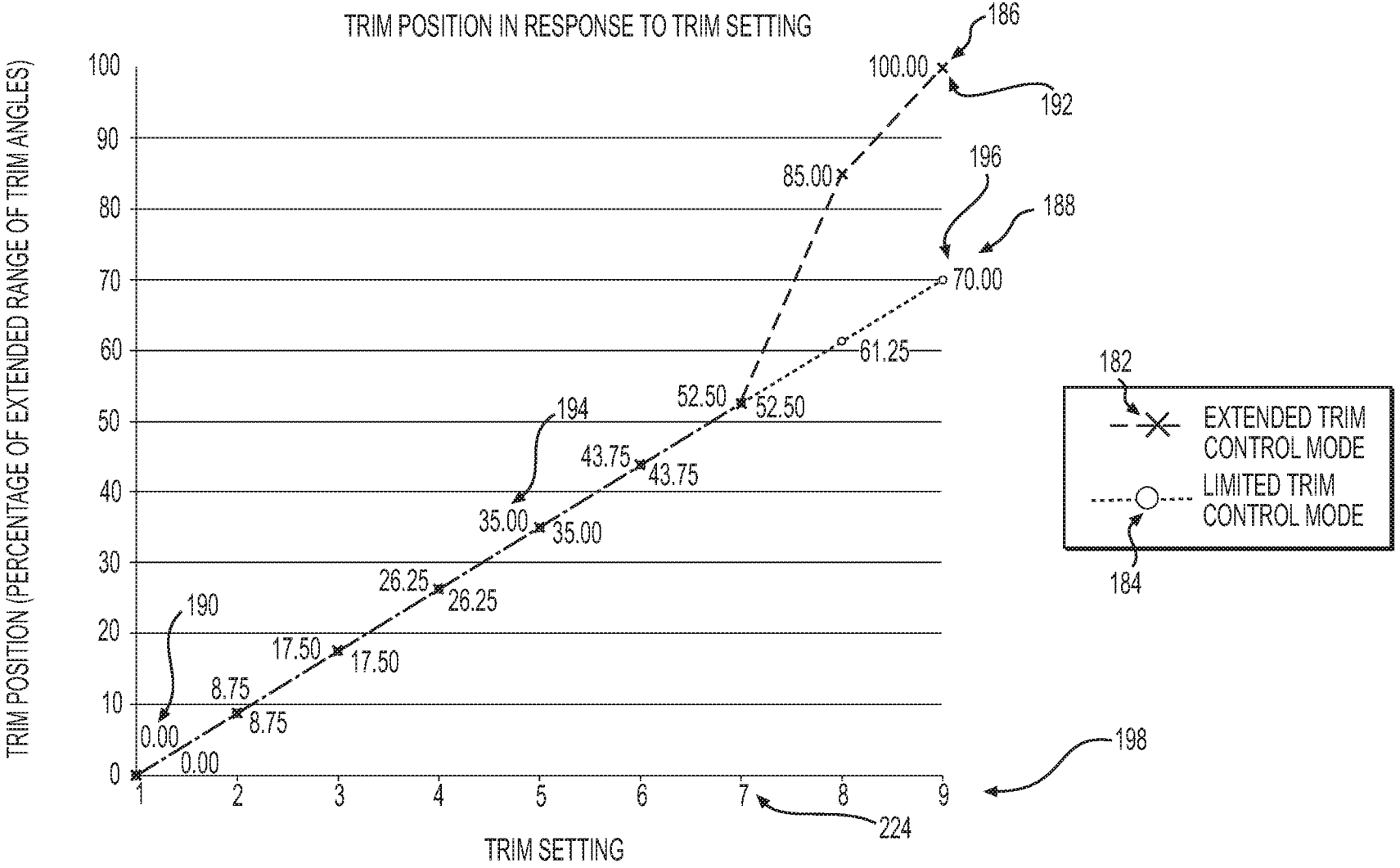
FIG. 12 is a graph illustrating trim position in response to trim setting in an extended trim control mode and in a limited trim control mode.

Turning now to FIGS. 10 to 12, a method for trimming the watercraft 10 using the trim system 150 will be described. The trim system 150 also comprises the previously introduced ECU 24, GPS 80 and trim input device 83. The ECU 24 (FIG. 1) is connected 176 to the GPS 80 for receiving a sensor input signal indicative of watercraft speed. The ECU 24 is also connected 178 to the trim input device 83 for receiving a trim input signal indicative of a desired trim setting selected by the driver. In the present embodiment, the driver selects one of nine trim settings 198 (see FIG. 12). Trim setting 1 is indicative of a desire for a maximum possible trim down position, trim setting 5 is indicative of a desire for a neutral trim position and trim setting 9 is indicative of a desire for a maximum possible trim up position. It is contemplated that there could be more or less than nine trim settings. Based on the received signals, the ECU 24 electronically controls 180 the trim actuator 156 as detailed in the method illustrated in FIG. 10. The ECU 24 controls the trim actuator 156 in one of a first, extended control trim mode 182 and a second, limited control mode 184. Trim angles corresponding to each of the trim settings for the extended and limited trim control modes 182, 184 are stored in a table accessible by the ECU 24. Alternatively, the ECU 24 could calculate the trim angles corresponding to the trim settings from one or more mathematical formulas. In another embodiment, each trim setting has a corresponding trim angle which the ECU 24 multiplies by a greater factor when in the extended trim control mode 182 than when in the limited trim control mode 184. In another alternative embodiment, the ECU 24 calculates the trim angle corresponding to a given trim setting based on a combination of tables, mathematical formulas and/or multiplication factor (s).

The method starts at step 200 when the watercraft 10 is started. When the watercraft 10 starts, the ECU 24 controls the trim actuator 156 in the extended trim control mode 182 at step 202. Then at step 204, the GPS 80 senses the watercraft speed and sends a signal indicative of this speed to the ECU 24. Then at step 206, the ECU 24 determines if the watercraft speed sensed at step 204 is above a watercraft speed threshold value stored in the ECU 24 or a separate memory device. In the present embodiment, the watercraft speed threshold value is 30 km/h. It is contemplated that the watercraft speed threshold could have a different value depending on the particular characteristics of the watercraft 10 and/or a different desired trim operation of the watercraft 10. If the watercraft speed is below or equal to the watercraft speed threshold value, then at step 208 the ECU 24 determines a trim setting selected by the driver based on the trim input signal. Then at step 210, the ECU 24 controls the trim actuator 156 to pivot the nozzle 152 about the trim axis 158 to a trim position corresponding to the trim setting determined at step 208. As at step 210 the ECU 24 controls the trim actuator 156 in the extended trim control mode 182, the trim position of the nozzle 152 is within an extended range of trim angles 186.

Referring to FIGS. 11 and 12, the extended range of trim angles 186 is defined between a maximum trim down angle 190 and a maximum trim up angle 192. The maximum trim down angle 190 and the maximum trim up angle 192 correspond to the maximum trim down and trim up angles at which the trim actuator 156 can position the nozzle 152.

In FIG. 12, the maximum trim down angle 190 corresponds to a 0% trim position and the maximum trim up angle 192 corresponds to a 100% trim position. A neutral trim angle 194 (i.e. a trim angle of zero degree when the nozzle 152 and the venturi 100 are coaxial) corresponds to a 35% trim position. In the present embodiment, the maximum trim down angle 190 (i.e. 0%) is −5 degrees and the maximum trim up angle 192 is 10 degrees. It is contemplated that these angular values could be different. It is also contemplated that the extended range of trim angles 186 could be a range of trim angles that is less than the full range of trim angles from the maximum trim down angle 190 to the maximum trim up angle 192, but which is greater than the limited range of trim angles 188 described below.

As can be seen in FIG. 12, when the trim setting determined at step 208 is trim setting 1, at step 210 the ECU 24 controls the trim actuator 156 to pivot the nozzle 152 about the trim axis 158 to the maximum trim down angle 190 (i.e. −5 degrees, 0%). When the trim setting determined at step 208 is trim setting 9, at step 210 the ECU 24 controls the trim actuator 156 to pivot the nozzle 152 about the trim axis 158 to the maximum trim up angle 192 (i.e. 10 degrees, 100%). When the trim setting determined at step 208 is trim setting 5, at step 210 the ECU 24 controls the trim actuator 156 to pivot the nozzle 152 about the trim axis 158 to the neutral trim angle 194 (i.e. zero degree, 35%). As can also be seen in FIG. 12, in the present embodiment the trim angle increases linearly from trim setting 1 to trim setting 7, and then increases more steeply from trim setting 7 to trim setting 9. It is contemplated that the trim angles corresponding to each of the trim settings 198 could differ from those illustrated.

From step 210, the ECU 24 returns to step 204. It should be noted that the ECU 24 does not wait until the nozzle 152 has reached the trim angle corresponding to the trim setting determined at step 208 before returning to step 204.

The ECU 24 continues to control the trim actuator 156 in the extended control mode 182 until it determines at step 206 that the watercraft speed exceeds the watercraft speed threshold value. At step 206, if the watercraft speed is above the watercraft speed threshold value, the ECU 24 goes to step 212 and begins to control the trim actuator 156 in the limited trim control mode 184.

From step 212, at step 214, the GPS 80 senses the watercraft speed and sends a signal indicative of this speed to the ECU 24. Then at step 216, the ECU 24 determines if the watercraft speed sensed at step 214 is below the watercraft speed threshold value. If the watercraft speed is above or equal to the watercraft speed threshold value, then at step 218 the ECU 24 determines a trim setting selected by the driver based on the trim input signal. Then at step 220 ECU 24 controls the trim actuator 156 to pivot the nozzle 152 about the trim axis 158 to a trim position corresponding to the trim setting determined at step 218. As at step 220 the ECU 24 controls the trim actuator 156 in the limited trim control mode 184, the trim position of the nozzle 152 is within a limited range of trim angles 188.

Referring to FIGS. 11 and 12, the limited range of trim angles 188 is defined between the maximum trim down angle 190 and a trim up angle 196 that is less than the maximum trim up angle 192. As such, the extended range of trim angles 186 is greater than the limited range of trim angles 188.

In FIG. 12, the trim up angle 196 corresponds to a 70% trim position. In some embodiments, the trim up angle 196 is half the highest trim up angle of the extended range of trim angles 186, which in the present embodiment is the maximum trim up angle 192. In the present embodiment, the trim up angle 196 is 5 degrees. It is contemplated that the trim up angle 196 could have a different value. It is contemplated that the limited range of trim angles 188 could be defined between the trim up angle 196 and a trim down angle that is between the maximum trim down angle 190 and the neutral trim angle 194.

As can be seen in FIG. 12, when the trim setting determined at step 218 is trim setting 1, at step 220 the ECU 24 controls the trim actuator 156 to pivot the nozzle 152 about the trim axis 158 to the maximum trim down angle 190 (i.e. −5 degrees, 0%). When the trim setting determined at step 218 is trim setting 9, at step 220 the ECU 24 controls the trim actuator 156 to pivot the nozzle 152 about the trim axis 158 to the trim up angle 196 (i.e. 5 degrees, 70%). When the trim setting determined at step 218 is trim setting 5, at step 220 the ECU 24 controls the trim actuator 156 to pivot the nozzle 152 about the trim axis 158 to the neutral trim angle 194 (i.e. zero degree, 35%). As can also be seen in FIG. 12, in the present embodiment the trim angle increases linearly from trim setting 1 to trim setting 9. It is contemplated that the trim angles corresponding to each of the trim settings 198 could differ from those illustrated. For example, it is contemplated that the trim angles corresponding to trim setting 7, 8 and 9 could all be the same (i.e. 2.875 degrees, 52.50%).

From step 220, the ECU 24 returns to step 214. It should be noted that the ECU 24 does not wait until the nozzle 152 has reached the trim angle corresponding to the trim setting determined at step 218 before returning to step 214.

If at step 216 the ECU 24 determines that the watercraft speed determined at step 214 is below the watercraft speed threshold value, then at step 222 the ECU 24 determines if the watercraft speed has been below the watercraft speed threshold value for longer than a predetermined delay value stored in the ECU 24 or a separate memory device. In the present embodiment, the predetermined delay value is three seconds, but it could be more or less. If at step 222 the watercraft speed has not been below the watercraft speed threshold value for longer than three seconds, the ECU 24 goes to step 218 and continues to control the trim actuator 156 in the limited trim control mode 184. If at step 222 the watercraft speed has been below the watercraft speed threshold value for longer than three seconds, the ECU 24 returns to step 202 and begins to control the trim actuator 156 in the extended trim control mode 182. It is contemplated that step 222 could be omitted and that the ECU 24 could go directly from step 216 to step 202 if it is determined at step 216 that the watercraft speed is below the watercraft speed threshold value.

As can be seen in FIG. 12, for trim settings 1 to 7, the trim angles corresponding to each of these settings are the same in both the extended and limited control modes 182, 184. For trim settings 8 and 9, it can be seen that the corresponding trim angles in the extended trim control mode 182 are greater than the corresponding trim angles in the limited trim control mode 184. As such, trim setting 7 is referred to herein as a threshold trim setting 224. Below and at the threshold trim setting 224, the trim angles are the same for both trim control modes 182, 184 and above the threshold trim setting 224 the trim angles are greater in the extended trim control mode 182 than in the limited trim control mode 184. It is contemplated that the threshold trim setting 224 could be at trim setting 8 or at a trim setting lower than trim setting 7. It is also contemplated that the trim angles and trim positions corresponding to trim settings 2 to 9 could always be greater in the extended trim control mode 182 than in the limited trim control mode 184. For example, in the extended trim control mode 182, the trim position could increase linearly from 0% at trim setting 1 to 100% at trim setting 9 and in the limited trim control mode 184, the trim position could increase linearly from 0% at trim setting 1 to 70% at trim setting 9. It is further contemplated that the trim angles could be different for all trim settings in the trim control modes 182, 184.

In this embodiment, when the watercraft speed is below the watercraft speed threshold value, and until it exceeds the watercraft speed threshold value, the ECU 24 controls the trim actuator 156 in the extended control mode 182. Under such circumstances, selecting a high trim setting (i.e. 8 or 9) results in a high trim up angle which can enhance the playfulness of the watercraft 10. When the watercraft 10 accelerates past the watercraft speed threshold value, the ECU 24 automatically selects the limited control mode 184 and if the ECU 24 determines that the trim setting corresponds to trim setting 8 or 9, the nozzle 152 is automatically pivoted downward to a lower, limited trim up angle. For example, if the trim setting is 9, the nozzle 152 will be pivoted down from a 10-degree (100%) trim angle to a 5-degree (70%) trim angle. This occurs without any intervention from the driver. Thereafter, when the watercraft speed falls below the watercraft speed threshold value for longer than the predetermined delay value and the trim setting corresponds to trim setting 8 or 9, the nozzle 152 is automatically pivoted upward to an extended trim up angle. For example, if the trim setting is 9, the nozzle 152 will be pivoted up from a 5-degree (70%) trim angle to a 10-degree (100%) trim angle. This also occurs without any intervention from the driver.

It is contemplated that watercraft operating condition threshold values, trim setting values, trim setting threshold values, trim angle values, trim extending factor values or delay values could be at least partially driver-programmable settings.

It is also contemplated that depending on the information stored on the key used with the watercraft 10, the trim may be controlled differently. For example, when inserting a normal key, the ECU 24 can control the trim in both the extended and limited control modes 182, 184 and when a key such as the Learning Key™ described above is inserted, the ECU 24 only controls the trim in the limited control mode 184 regardless of watercraft speed.

It is also contemplated that at steps 206, 216 and 222 threshold values for watercraft operating conditions other than watercraft speed may be used. Non-limiting examples of watercraft operating conditions that could be used instead of watercraft speed include: motor speed, motor speed input device 76 position, water pressure in the jet propulsion system 86, water flow speed in the jet propulsion system 86. In such embodiments, the ECU 24 would receive a signal indicative of such a watercraft operating condition from a suitable sensor. It is also contemplated that the ECU 24 could consider two or more watercraft operating conditions in determining whether to control the trim actuator 156 in the extended trim control mode 182 or the limited trim control mode 184.

It is also contemplated that the trim setting could be selected automatically by the ECU 24 based on operating conditions and that the trim input device 83 could be omitted.

In some watercraft, the ECU 24 controls the motor 22 in a reduced performance control mode, such as a "limp home" control mode, when receiving a fault or an error signal from one or more sensors of the watercraft 10. Such reduced performance control modes cause the motor speed to be limited. In some embodiments, when the ECU 24 controls the motor 22 in a reduced performance control mode, the ECU 24 also controls the trim actuator 156 in the limited trim control mode 184 even if the watercraft speed is below the watercraft speed threshold value.

It is also contemplated that the ECU 24 could control the trim control actuator 156 in more modes than just the extended and limited trim control modes 182, 184. For example, the ECU 24 could control the trim control actuator 156 in an idle trim control mode when the watercraft speed is below an idle speed of 5 km/h for example. In such an idle trim control mode, the ECU 24 would control the trim actuator 156 to pivot the nozzle 152 to a predefined trim up angle regardless of the selected trim setting, such that the nozzle 152 would already be ideally positioned upon acceleration of the watercraft 10.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A watercraft comprising:

a hull;

a deck disposed on the hull;

a motor disposed between the hull and the deck;

a jet propulsion system operatively connected to the motor and connected to the hull, the jet propulsion system comprising:

a jet pump operatively connected to the motor; and a nozzle pivotally connected about a trim axis, the nozzle being disposed at least in part rearward of the jet pump, the nozzle being at least in part aligned with an outlet of the jet pump for selectively redirecting a jet of water expelled by the jet pump;

a trim actuator operatively connected to the nozzle for pivoting the nozzle about the trim axis;

at least one sensor for sensing at least one operating condition of the watercraft, the at least one operating condition of the watercraft being at least one of watercraft speed, motor speed, motor speed input device position, water pressure in the jet propulsion system, and water flow speed in the jet propulsion system;

a control unit electronically connected to the at least one sensor for receiving a sensor input signal from the at least one sensor and to the trim actuator for controlling the trim actuator, the sensor input signal being indicative of the at least one operating condition, the control unit controlling the trim actuator to pivot the nozzle about the trim axis in a selected one of at least a first trim control mode and a second trim control mode, in the first trim control mode, the control unit controlling the trim actuator to pivot the nozzle about the trim axis within a first range of trim angles, in the second trim control mode, the control unit controlling the trim actuator to pivot the nozzle about the trim axis within a second range of trim angles, the first range of trim angles being greater than the second range of trim angles, the control unit controlling the trim actuator in the first trim control mode when the at least one operating condition is below a threshold value of the at least one operating condition until the at least one operating condition exceeds the threshold value, the control unit controlling the trim actuator in the second trim control mode when the at least one operating condition is above the threshold value of the at least one operating condition.

2. The watercraft of claim 1, wherein:

the first range of trim angles is defined between a first trim down angle and a first trim up angle;

the second range of trim angles is defined between the first trim down angle and a second trim up angle; and the first trim up angle is greater than the second trim up angle.

3. The watercraft of claim 2, wherein:

the first trim down angle is a maximum trim down angle; and the first trim up angle is a maximum trim up angle.

4. The watercraft of claim 2, further comprising a driver-actuated trim input;

wherein:

the control unit is electronically connected to the driver-actuated trim input for receiving a trim input signal indicative of a desired trim setting;

the control unit controls the trim actuator to pivot the nozzle about the trim axis based at least in part on the trim input signal; and when the desired trim setting is above a threshold desired trim setting:

the control unit controls the trim actuator to pivot the nozzle about the trim axis to a first trim angle when the control unit controls the trim actuator in the first trim control mode;

the control unit controls the trim actuator to pivot the nozzle about the trim axis to a second trim angle when the control unit controls the trim actuator in the second trim control mode; and the first trim angle is greater than the second trim angle.

5. The watercraft of claim 4, wherein when the desired trim setting is below the threshold desired trim setting:

the control unit controls the trim actuator to pivot the nozzle about the trim axis to a third trim angle when the control unit controls the trim actuator in the first trim control mode;

the control unit controls the trim actuator to pivot the nozzle about the trim axis to a fourth trim angle when the control unit controls the trim actuator in the second trim control mode; and the third trim angle is equal to the fourth trim angle.

6. The watercraft of claim 1, wherein when the control unit controls the trim actuator in the second trim control mode and the at least one operating condition falls below the threshold value of the at least one operating condition:

the control unit continues to control the trim actuator in the second trim control mode until the at least one operating condition has been below the threshold value of the at least one operating condition for a predetermined delay; and the control unit returns to controlling the trim actuator in the first trim control mode when the at least one operating condition has been below the threshold value of the at least one operating condition for at least the predetermined delay.

7. The watercraft of claim 1, wherein the at least one sensor is a watercraft speed sensor and the at least one operating condition is the watercraft speed.

8. A trim system for a watercraft comprising:

a nozzle adapted for being pivotally connected about a trim axis;

a trim actuator operatively connected to the nozzle for pivoting the nozzle about the trim axis;

at least one sensor for sensing at least one operating condition of the watercraft, the at least one operating condition of the watercraft being at least one of watercraft speed, motor speed, motor speed input device position, water pressure in a jet propulsion system of the watercraft, and water flow speed in the jet propulsion system;

a control unit electronically connected to the at least one sensor for receiving a sensor input signal from the at least one sensor and to the trim actuator for controlling the trim actuator, the sensor input signal being indicative of the at least one operating condition, the control unit controlling the trim actuator to pivot the nozzle about the trim axis in a selected one of at least a first trim control mode and a second trim control mode, in the first trim control mode, the control unit controlling the trim actuator to pivot the nozzle about the trim axis within a first range of trim angles, in the second trim control mode, the control unit controlling the trim actuator to pivot the nozzle about the trim axis within a second range of trim angles, the first range of trim angles being greater than the second range of trim angles, the control unit controlling the trim actuator in the first trim control mode when the at least one operating condition is below a threshold value of the at least one operating condition until the at least one operating condition exceeds the threshold value, the control unit controlling the trim actuator in the second trim control mode when the at least one operating condition is above the threshold value of the at least one operating condition.

9. The trim system of claim 8, wherein:

the first range of trim angles is defined between a first trim down angle and a first trim up angle;

the second range of trim angles is defined between the first trim down angle and a second trim up angle; and the first trim up angle is greater than the second trim up angle.

10. The trim system of claim 9, wherein:

the first trim down angle is a maximum trim down angle; and the first trim up angle is a maximum trim up angle.

11. The trim system of claim 9, further comprising a driver-actuated trim input;

wherein:

the control unit is electronically connected to the driver-actuated trim input for receiving a trim input signal indicative of a desired trim setting, the control unit controls the trim actuator to pivot the nozzle about the trim axis based at least in part on the trim input signal; and when the desired trim setting is above a threshold desired trim setting:

the control unit controls the trim actuator to pivot the nozzle about the trim axis to a first trim angle when the control unit controls the trim actuator in the first trim control mode;

the control unit controls the trim actuator to pivot the nozzle about the trim axis to a second trim angle when the control unit controls the trim actuator in the second trim control mode; and the first trim angle is greater than the second trim angle.

12. The trim system of claim 11, wherein when the desired trim setting is below the threshold desired trim setting:

the control unit controls the trim actuator to pivot the nozzle about the trim axis to a third trim angle when the control unit controls the trim actuator in the first trim control mode;

the control unit controls the trim actuator to pivot the nozzle about the trim axis to a fourth trim angle when the control unit controls the trim actuator in the second trim control mode; and the third trim angle is equal to the fourth trim angle.

13. The trim system of claim 8, wherein when the control unit controls the trim actuator in the second trim control mode and the at least one operating condition falls below the threshold value of the at least one operating condition:

the control unit continues to control the trim actuator in the second trim control mode until the at least one operating condition has been below the threshold value of the at least one operating condition for a predetermined delay; and the control unit returns to controlling the trim actuator in the first trim control mode when the at least one operating condition has been below the threshold value of the at least one operating condition for at least the predetermined delay.

14. The trim system of claim 8, wherein the at least one sensor is a watercraft speed sensor and the at least one operating condition is the watercraft speed.

15. A method for controlling a trim of a watercraft comprising:

sensing at least one operating condition of the watercraft, the at least one operating condition of the watercraft being at least one of watercraft speed, motor speed, motor speed input device position, water pressure in a jet propulsion system of the watercraft, and water flow speed in the jet propulsion system;

controlling a trim actuator to pivot a nozzle of a jet propulsion system of the watercraft about a trim axis in a first trim control mode when the at least one operating condition is below a threshold value of the at least one operating condition until the at least one operating condition exceeds the threshold value; and controlling the trim actuator to pivot the nozzle about the trim axis in the second trim control mode when the at least one operating condition is above the threshold value of the at least one operating condition, in the first trim control mode, the trim actuator is controlled to pivot the nozzle about the trim axis within a first range of trim angles, in the second trim control mode, the trim actuator is controlled to pivot the nozzle about the trim axis within a second range of trim angles, and the first range of trim angles being greater than the second range of trim angles.

16. The method of claim 15, wherein:

the first range of trim angles is defined between a first trim down angle and a first trim up angle;

the second range of trim angles is defined between the first trim down angle and a second trim up angle; and the first trim up angle is greater than the second trim up angle.

17. The method of claim 16, further comprising:

determining a desired trim setting from a driver-actuated trim input; and based at least in part on the desired trim setting, when the desired trim setting is above a threshold desired trim setting:

controlling the trim actuator in the first trim control mode controls the trim actuator to pivot the nozzle about the trim axis to a first trim angle; and controlling the trim actuator in the second trim control mode controls the trim actuator to pivot the nozzle about the trim axis to a second trim angle;

wherein the first trim angle is greater than the second trim angle.

18. The method of claim 17, wherein based at least in part on the desired trim setting, when the desired trim setting is below the threshold desired trim setting:

controlling the trim actuator in the first trim control mode controls the trim actuator to pivot the nozzle about the trim axis to a third trim angle; and controlling the trim actuator in the second trim control mode controls the trim actuator to pivot the nozzle about the trim axis to a fourth trim angle;

wherein the third trim angle is equal to the fourth trim angle.

19. The method of claim 15, wherein when the trim actuator is controlled in the second trim control mode:

determining if the at least one operating condition falls below the threshold value of the at least one operating condition; and if the at least one operating condition falls below the threshold value of the at least one operating condition:

continuing to control the trim actuator in the second trim control mode until the at least one operating condition has been below the threshold value of the at least one operating condition for a predetermined delay; and returning to control the trim actuator in the first trim control mode when the at least one operating condition has been below the threshold value of the at least one operating condition for at least the predetermined delay.

20. The method of claim 15, wherein the at least one operating condition is watercraft speed.

* * * * *